US009376296B2

(12) United States Patent
Nussbaum

(10) Patent No.: US 9,376,296 B2
(45) Date of Patent: Jun. 28, 2016

(54) VEHICLE HOIST

(71) Applicant: Otto Nussbaum GmbH & Co. KG, Kehl-Bodersweier (DE)

(72) Inventor: Hans Nussbaum, Kehl-Bodersweier (DE)

(73) Assignee: Otto Nussbaum GmbH & Co. KG, Kehl-Bodersweier (DE)

( * ) Notice: Subject to any disclaimer, the term of this patent is extended or adjusted under 35 U.S.C. 154(b) by 338 days.

(21) Appl. No.: 14/025,056

(22) Filed: Sep. 12, 2013

(65) Prior Publication Data

US 2014/0076665 A1 Mar. 20, 2014

(30) Foreign Application Priority Data

Sep. 12, 2012 (DE) ..... 10 2012 017 959

(51) Int. Cl.
*B66F 7/28* (2006.01)
*B66F 7/20* (2006.01)

(52) U.S. Cl.
CPC .... *B66F 7/28* (2013.01); *B66F 7/20* (2013.01)

(58) Field of Classification Search
CPC ..... B66F 7/20; B66F 7/28; B66F 7/06; B66F 7/08; B60S 9/22; B60S 13/00
USPC ..... 187/219, 218
See application file for complete search history.

(56) References Cited

U.S. PATENT DOCUMENTS 3,822,766 A * 7/1974 Suter ..... B65G 1/0407 187/291
4,763,761 A * 8/1988 McKinsey ..... B66F 7/04 187/207
5,679,934 A * 10/1997 Juntunen ..... B66B 1/462 187/384
5,954,160 A 9/1999 Wells, Sr. et al.
6,279,685 B1 * 8/2001 Kogan ..... G66F 7/28 187/203
6,286,629 B1 * 9/2001 Saunders ..... B66B 9/0853 187/394
6,315,079 B1 * 11/2001 Berends ..... B66F 3/46 187/203
6,634,461 B1 * 10/2003 Baker ..... B66F 7/20 187/210
7,191,038 B2 * 3/2007 Green ..... B66F 7/04 254/45
7,219,769 B2 * 5/2007 Yamanouchi ..... B66F 9/0755 187/222
7,500,816 B2 * 3/2009 Berends ..... B66F 3/46 187/210

(Continued)

FOREIGN PATENT DOCUMENTS

DE 102005000883 7/2006
DE 102008021149 10/2009

(Continued)

*Primary Examiner* — William A Rivera
*Assistant Examiner* — Michael Riegelman
(74) *Attorney, Agent, or Firm* — Volpe and Koenig, P.C.

(57) ABSTRACT

A hoist for vehicles having two lifting columns arranged at both sides of a vehicle, each having two support arms that are supported in a horizontally pivotal and longitudinally adjustable fashion at their lifting column, and each having at their free end a support plate. These support plates are positionable at support positions underneath a vehicle as specified by the vehicle manufacturer by an appropriate movement of the support arm. The manufacturer support positions are saved as target positions according to corresponding vehicle model in a data memory of the hoist, and coordinates of actual positions of the support plates are determined by measurements and perhaps calculations. A computer makes a comparison between the target and actual coordinates, and enables a lifting process of the support arms only when differences between the target and the actual coordinates are within a predetermined tolerance.

15 Claims, 6 Drawing Sheets

(56) References Cited

U.S. PATENT DOCUMENTS

| | | | | |
|---|---|---|---|---|
| 7,644,807 | B2 * | 1/2010 | Finkbeiner | B66F 3/46 187/224 |
| 8,083,034 | B2 * | 12/2011 | Bordwell | B66F 7/20 187/210 |
| 8,256,577 | B2 * | 9/2012 | Kritzer | B66F 3/46 187/215 |
| 2002/0175319 | A1 * | 11/2002 | Green | B66F 7/04 254/45 |
| 2005/0045429 | A1 | 3/2005 | Baker | |
| 2007/0034420 | A1 * | 2/2007 | Stanford | B66F 3/46 177/146 |
| 2008/0277204 | A1 * | 11/2008 | Moller | B66F 3/24 187/247 |
| 2008/0296071 | A1 | 12/2008 | Herrmann | |
| 2009/0271041 | A1 | 10/2009 | Knestel et al. | |
| 2011/0037041 | A1 * | 2/2011 | DeJong | B66F 3/46 254/89 R |
| 2011/0097187 | A1 * | 4/2011 | Kelley | B66F 7/28 414/814 |
| 2013/0240300 | A1 * | 9/2013 | Fagan | B66F 3/46 187/210 |
| 2014/0196960 | A1 * | 7/2014 | Rothkegel | B66F 7/28 177/132 |

FOREIGN PATENT DOCUMENTS

| | | |
|---|---|---|
| EP | 1876136 | 1/2008 |
| EP | 2316778 | 5/2011 |
| JP | 2008254825 | 10/2008 |
| WO | 0234665 | 5/2002 |

* cited by examiner

VEHICLE HOIST

INCORPORATION BY REFERENCE

The following documents are incorporated herein by reference as if fully set forth: German Patent Application No.: 102012017959.6, filed Sep. 12, 2012.

BACKGROUND

The invention relates to a hoist for vehicles comprising two lifting columns, which are arranged at both sides of a vehicle and each comprise two support arms, with these support arms being supported in a horizontally pivotal and longitudinally adjustable fashion at their lifting column and each comprising at their free end a support plate, and these support plates shall be positioned at the support position underneath the vehicle as stipulated by the vehicle manufacturer by an appropriate movement of the support arm.

Hoists of the generic type described at the outset are known in various embodiments and have proven in practice, because they are suitable for small as well as large vehicles due to their variable support arms. The pivoting inwardly and the longitudinal adjustment of the support arms to position the support plates at the support position as stipulated by the vehicle manufacturer underneath the vehicle occurs by the operator, after the vehicle has been driven into the hoist.

SUMMARY

The present invention is based on the acknowledgement that the visual judgment and diligence required for the precise adjustment of the support arms cannot always be assumed for every operator. Accordingly the present invention is based on the objective of improving a hoist of the generic type described at the outset such that the adjustment of the support arms into the specified support position can be realized more reliably than in the past.

This objective is attained according to the invention such that the coordinates of the support position stipulated by the manufacturer in connection with the respectively corresponding vehicle model is saved as the target position in a data memory of the hoist, that the coordinates of the actual positions of the support plates are determined by measurement and perhaps calculation, that via a computer a comparison occurs of the target coordinates and the actual coordinates, and a lifting process of the support arms is only enabled when the differences between the target coordinates and the actual coordinates are within a predetermined tolerance.

According to the invention here a monitoring occurs of the settings of the support arms. The safety during the lifting process is therefore no longer dependent merely on the visual judgment and diligence of the operator; rather a lifting process is only possible when it is ensured that all four support arms with their support plates are located in the correct position. The hoist according to the invention is therefore characterized in a considerably increased operating safety; it can no longer occur that due to a false positioning the support plates the vehicle underbody is indented or the vehicle locally slips due to the support plates being located too far outside.

An advantageous further development of the invention comprises that the target and the actual positions are additionally shown in a display. This way the operator recognizes which of the four support arms needs to be readjusted and to what extent that has to occur. In particular the operator here no longer needs to kneel on the shop floor in order to control the area underneath the vehicle, which is hard to see. Rather this control can occur comfortably via the display.

In this context, another beneficial embodiment of the invention comprises that the target positions shown in their entirety and/or the actual positions shown in their entirety can be shifted on the display. This ability for displacement includes not only a movement in the linear x-direction and y-direction but also a rotation and has the following purpose: In practice it cannot always be ensured that the vehicle has been driven into the hoist to the ideal position; for example the vehicle may be driven into the hoist diagonally, laterally off-set, or a bit too short or too far. In order to prevent any adjustment errors beneficially the indicated target positions are here displaced in their entirety such that they match the vehicle position. This can occur such that the support arm allocated to one or two easily discernible support positions of the vehicle approaches (these positions) and that subsequently the corresponding target position is made to overlap the actual position of said support arm on the display. In this process of overlapping positions of course the other predetermined target positions are entrained to the same extent so that all four target positions are now matching the vehicle position. The adjustment of the remaining support arms can then easily be controlled via the display.

Sometimes it may be sufficient when the displacement of the indicated target positions or the actual positions shown on the display is possible only in the x-direction and the y-direction. However, if a hoist designed for large vehicles with an appropriately wide distance of the lifting columns shall also be used for vehicles of a compact design it is beneficial to perform the displacement of the target positions or actual positions on the display not only in a translational fashion but also a rotational one in order to allow a better consideration of a diagonal position of the vehicle in the hoist.

The determination of the actual coordinates of the support plates occurs beneficially by measuring the pivotal angle of the support arms and by measuring the length of the support arms. Appropriate sensors for angles and distances are known in prior art.

In order to increase the operating safety of the hoist it is recommended to arrange sensors at the support arm which check if the common locking lever is engaged for blocking any undesired pivotal motion of the support arm and prevents the operation of the hoist when this is not the case.

A further addition of the present invention includes that the pivoting and/or the adjustment in length of the support arms occurs in a motorized and automated fashion by the computer comparing the target data and the actual data. This way the complete adjustment of the support arms can be automated both prior to the lifting process as well as after the lifting process. At the most the first support arm still needs to be brought into the target position by the operator in order to allow adjusting the indicated target positions to the vehicle position.

However if the position of the vehicle located in the hoist is detected optically and this position is fed to the computer performing the comparison of the target coordinates with the actual coordinates then the guidance of the target position to (match) the vehicle position can be automated and the first support arm no longer needs to be moved into the target position by the operator.

In some vehicles the support positions of said vehicle at the front and the rear are not located on the same level. In this case the target and actual coordinates can be detected not only in the x-direction and y-direction but also in the z-direction so that the computer also performs compensation in the z-direction. In this case it is recommended for an automated operation of the hoist that the support plates are each combined with a lifting motor, which is controlled by the computer.

Another beneficial further development of the invention, which is helpful independent from the measurement and the comparison of the target and the actual values of the support positions comprises that the support arms respectively include a sensor for determining the weight of the vehicle impacting the support arm. This sensor is preferably embodied by strain gauges; however other suitable sensors may also be used, here.

It is essential that the weight determined by every sensor is fed to a computer for controlling the overall load and for checking the load distribution.

Here each individual support arm is checked with regards to the load permissible as well as the load distribution between the front and the rear support arms, in order to ensure the structural stability of the lifting columns. If the determined weight is excessive per support arm or overall or the load distribution is too uneven here the computer can prevent a lifting process.

In this context a plausibility check can occur of the weight measured at the support arms, on the one hand, and the weight resulting at the two support columns, on the other hand. If the support columns are operated hydraulically, for example, from the hydraulic pressure and the known piston area here the compensated weight is calculated and this weight can be compared by the above-mentioned computer with the total weight determined for the front and rear support arm of said support column. This results in an additional increase of the operational safety.

Another further development with regards to technical safety comprises that the hoist documents every lifting process with regards to target and actual positions of the support plates, if applicable also with regards to the weights and perhaps with regards to the locking of the support arms. This way, in case of a potential malfunction, accident, or the like the causes therefore can be reliably analyzed.

Finally, the scope of the invention also includes that the data memory and the computer are not only responsible for one hoist but for several ones. This reduces the expense for the installation. In order to avoid laying long lines here it is possible to wirelessly transmit the data to the central computer.

BRIEF DESCRIPTION OF THE DRAWINGS

Additional features and advantages of the invention are discernible from the following description of an exemplary embodiment and from the drawings. In the drawings:

FIG. 1 is a perspective view of the hoist with a vehicle driving in;

DETAILED DESCRIPTION OF THE PREFERRED EMBODIMENTS

Figure 1:
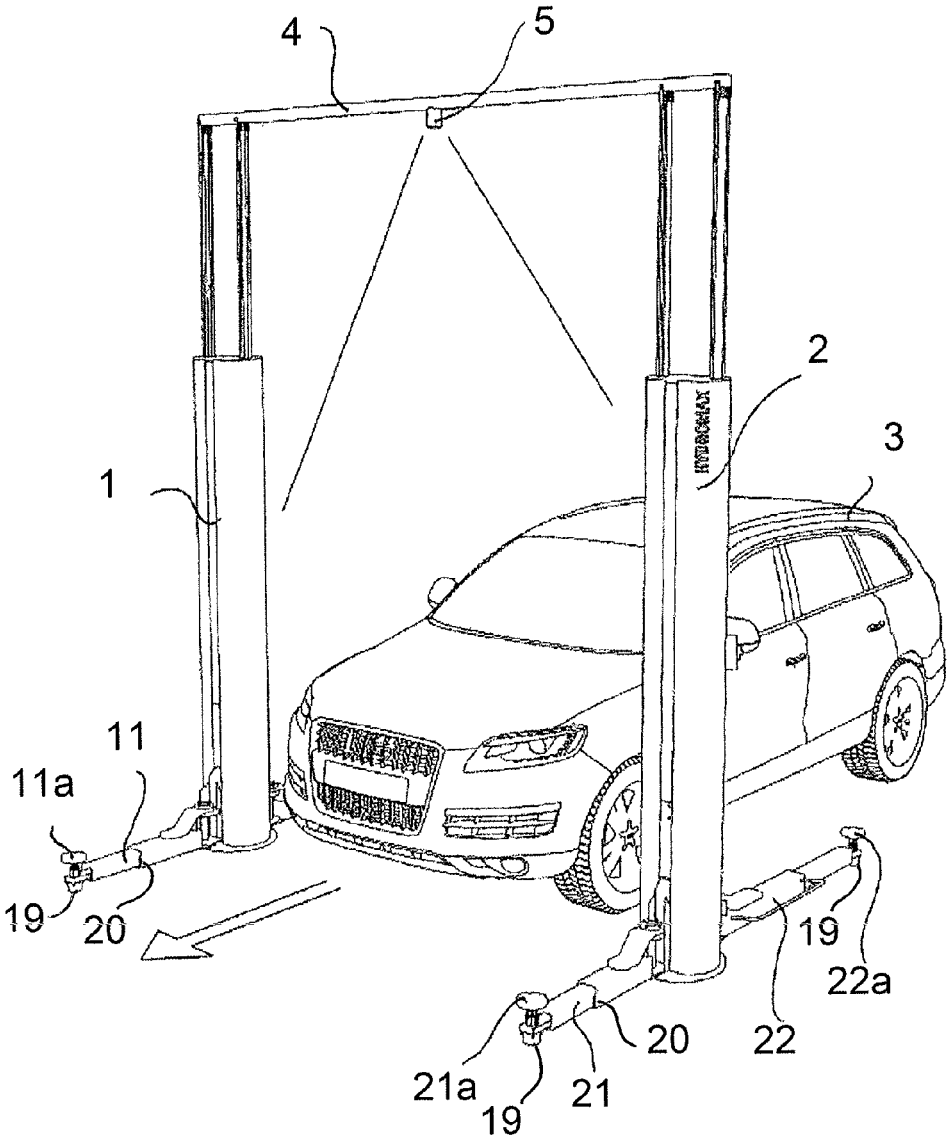

FIG. 1 shows two lifting columns 1 and 2, which are arranged at both sides of a vehicle 3 driving in. Both lifting columns are equipped with support arms 11 and 12 and/or 21 and 22. These support arms are supported in a manner known per se at their respective lifting column in a horizontally pivotal fashion and are additionally telescopic in the longitudinal direction so that after the vehicle has entered they can be pivoted out of their exterior normal position underneath the vehicle before the lifting process starts. At their free ends the support arms each comprise a support plate 11*a*, 12*a* and/or 21*a* and 22*a*, adjustable with regards to height. These support plates must be positioned underneath certain support positions under the vehicle, which are predetermined by the manufacturer, so that during the lifting process they can compensate the weight of the vehicle without damaging said vehicle.

In order to control a synchronous operation of both lifting columns 1 and 2 they are connected to each other by a bridge 4, which comprises control lines known per se.

Here, it is essential that the entry area of the hoist is monitored optically, for example by a camera 5. Its objective is to detect the contour of the vehicle in reference to the hoist after the vehicle has been driven into the hoist.

Figure 2:
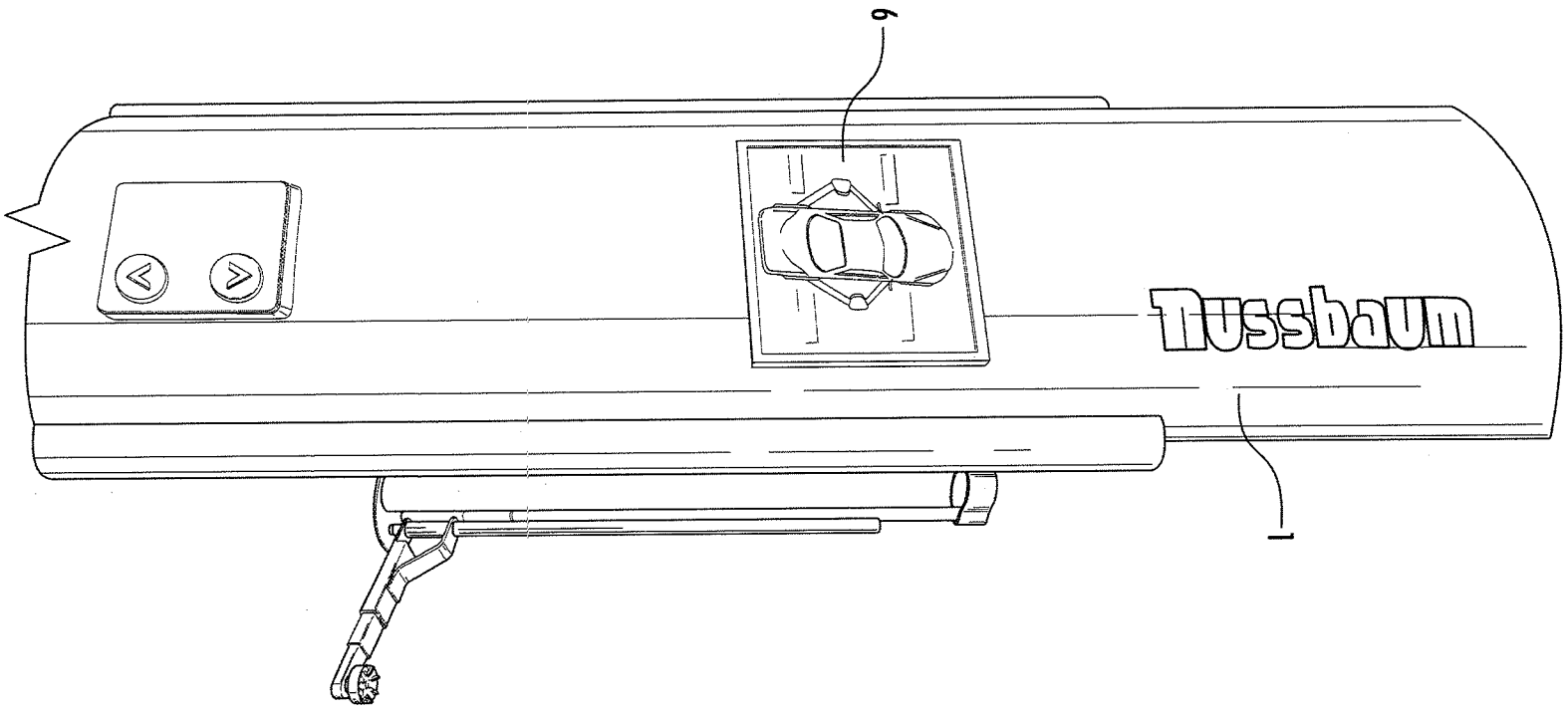
FIG. 2 is an enlarged perspective view of a lifting column with a display.

FIG. 2 shows an enlarged detail of the lifting column 1, seen from the outside. It is discernible that this lifting column is equipped with a display 6. This display shows the target and actual positions of the four support plates 11*a*, 12*a*, 21*a*, 22*a*, as well as the loads compensated by the support arms.

Figure 3:
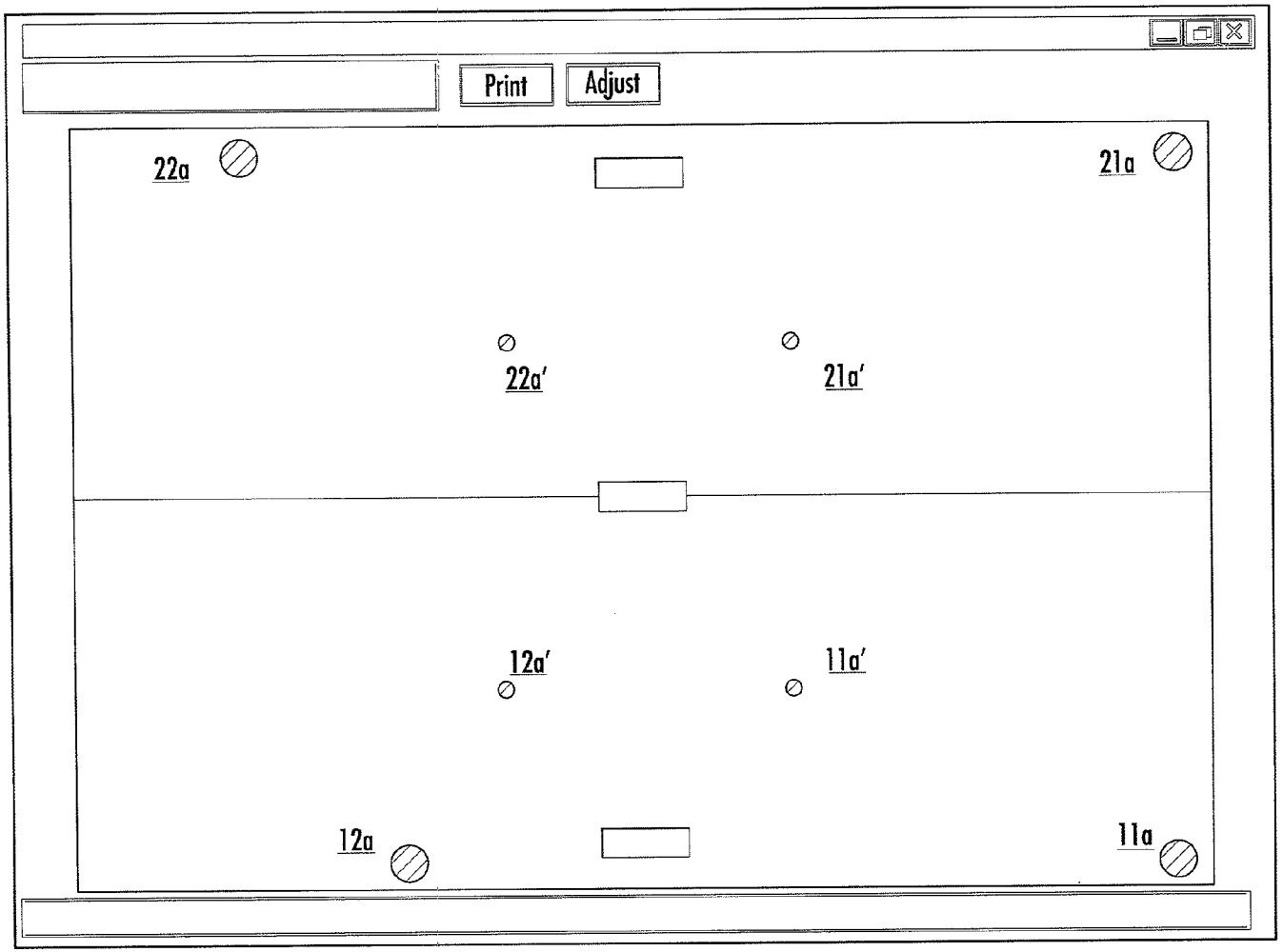
FIG. 3 is a view of the display with the target and actual positions with the support arms not yet pivoted inwardly.

FIG. 3 shows the display in an enlarged illustration after the vehicle has been driven into the hoist, however the support arms are still in their exterior normal position. Accordingly it is discernible in FIG. 3 that the front support plates 11*a* and 21*a* as well as the rear support plates 12*a* and 22*a* appear at the exterior edge of the display.

Figure 6:
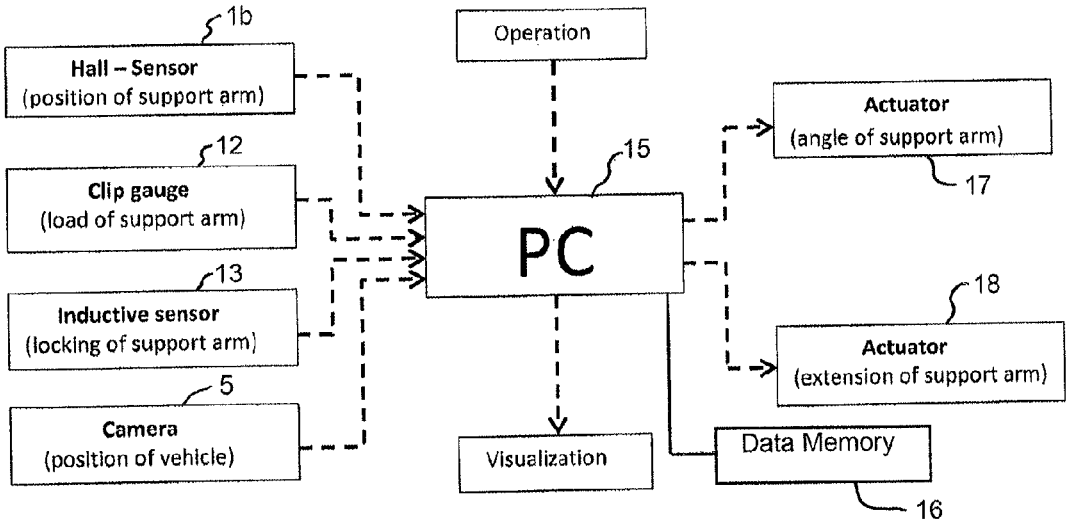
FIG. 6 is a block diagram.

Additionally the display shows the target support positions specified by the manufacturer already obtained from the data memory 16 (cf. FIG. 6). For a facilitated allocation these target positions are marked with the same reference characters, but additionally also marked with ', thus 11*a*', 12*a*', 21*a*', and 22*a*'.

In FIG. 3 the target values for the support positions are not precisely symmetrical in reference to the central axis marked. Rather, they are slightly off-set towards the passenger's side. This is caused in the vehicle contour being detected by the camera 5. In the exemplary embodiment this vehicle contour is located not precisely in the center between the two lifting columns 1 and 2 but slightly off-set towards the passenger's side. This was detected by the computer analyzing the camera image and resulted in a corresponding displacement of the target positions 11*a*', 12*a*', 21*a*', and 22*a*', thus an adjustment of these target positions to the actual vehicle position.

Figure 4:
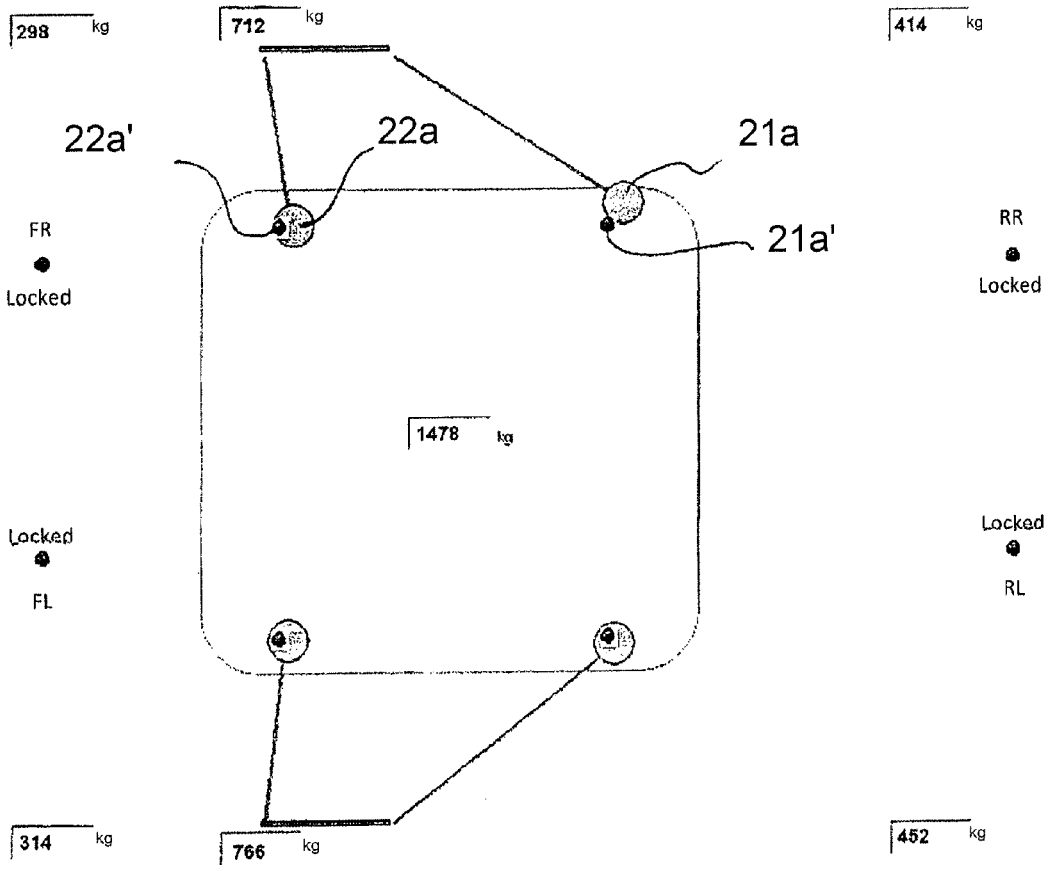
FIG. 4 is a view of the display with the target and actual positions and with the weights when the support arms are pivoted inwardly and lifted.

Based on FIG. 3, the operator now can pivot the four support arms from their exterior normal position inwardly underneath the vehicle until all support plates have assumed their target positions indicated in the display. This status is shown in FIG. 4. The approach to these target positions can easily be monitored via the display, if necessary also corrected subsequently, because the actual positions of the support plates are measured constantly and transmitted to the computer and thus also to the display 6. Only when all support plates have reached their target positions the lifting process is enabled. A lift motor 19 can be connected with each of the support plates 11*a*, 12*a*, 21*a*, 22*a*.

FIG. 4 shows the display 6 in another application, namely during the simultaneous measurement of the weight impacting the support arms. It is discernible that the support arm at the left front is loaded with 314 kg, the support arm at the right front with 298 kg, however the left rear support arm with 452 kg and the right (rear) one with 414 kg. This load distribution between the individual support arms, as well as the total load left, right, front, and rear and the overall load are constantly measured and must be within predetermined limits, otherwise the computer 15 (cf. FIG. 6) supplied with this data prevents the lifting process. This beneficially represents the same computer also responsible for the comparison of the target and the actual coordinates.

The display in FIG. 4 also shows if the support arms are locked with regards to their pivotal range. This locking occurs by a so-called support arm lock and is scanned by a respective sensor. If one of the support arms is not locked this fact is indicated and the lifting process is blocked.

Figure 5:
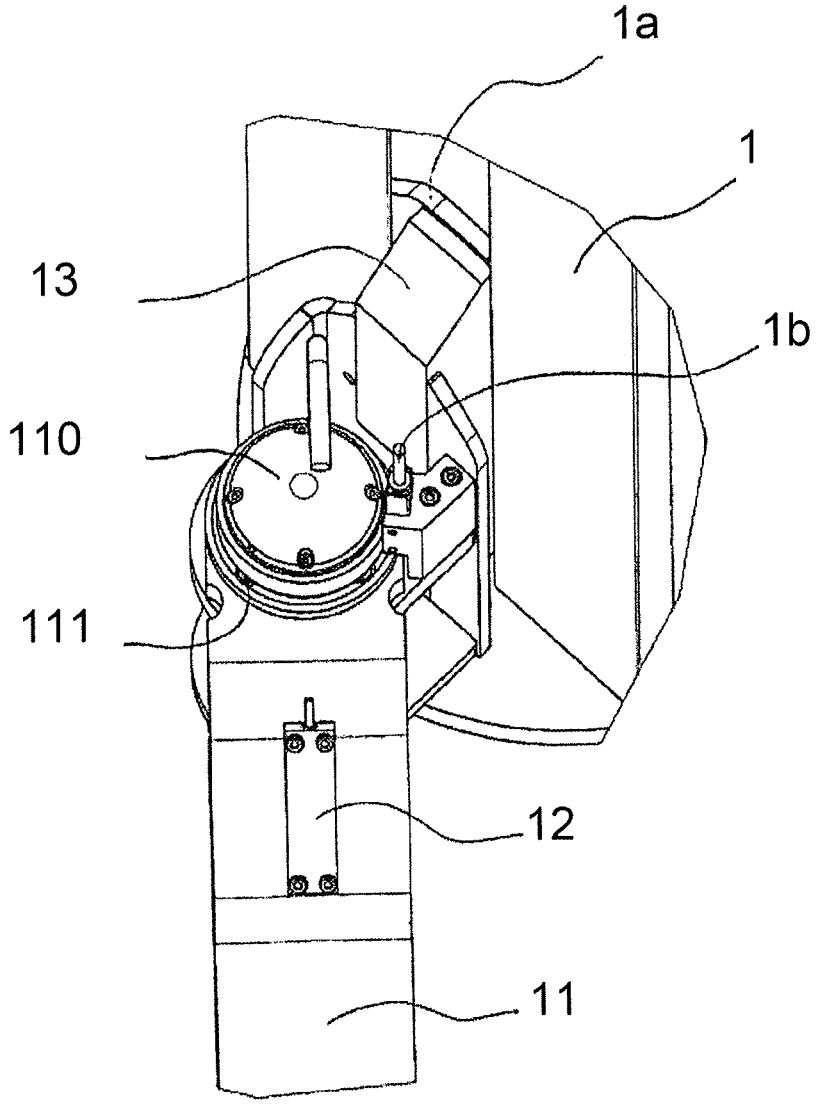
FIG. 5 an enlarged detail view of the support arm-pivot point at the support column.

FIG. 5 shows an enlarged detail in the pivoting range of a support arm, in the exemplary embodiment the support arm 11 at its column 1. Here, the support arm 11 is supported in a manner known per se via a pivotal bearing 110 with a vertical axis of rotation at a lifting sled 1*a* of a lifting column 1. The lifting sled 1*a* can be driven mechanically or hydraulically in a manner known per se.

It is now essential that the pivotal bearing 110 is combined with an angle meter. There are various options available for one trained in the art to be used as angle measuring devices. In the exemplary embodiment it comprises a magnetic ring 111, entrained during the pivotal motion of the support arm 11, and a Hall-sensor 1*b* fastened at the lifting sled. This Hall-sensor detects the pivotal angle and transmits respective signals to the computer 15.

Furthermore, each support arm is equipped with a length measuring device connected to the computer 15. The length measuring device is indicated generally at 20 and is not shown in greater detail in the drawing, because here many systems of prior art are suitable.

Additionally FIG. 5 shows that the support arm 11 is equipped with a sensor 12 to determine the weight impacting the support arm. This sensor is preferably embodied as a clip gauge and also transmits its signals to the above-mentioned computer.

Finally FIG. 5 also shows the lock for the support arm against any unintended pivoting of the support arm 11. Commonly the support arm 11, after having reached the desired pivotal position, is blocked by a toothed locking lever, which is not shown in greater detail in the drawing. The lifting sled 1*a* is now equipped with a sensor 13 reacting to this locking lever. The sensor 13 is also connected to the above-mentioned computer 15 so that the computer interrupts the lifting process of the hoist if the locking lever is not engaged in the locking position.

FIG. 6 shows a graphic illustration of the data flux. A computer 15 is shown in the center. This computer 15 also includes the data memory 16, in which the target positions are saved, which are predetermined by the manufacturer for the support plates in combination with the respectively allocated vehicle model.

The computer 15 is provided via sensors, allocated to each support arm, with their angular position and their longitudinal extension and thus obtains the actual position of the support plates. It compares these actual positions with the predetermined target positions and then issues the appropriate control signals to the actuators 17 for the angle of the support arm and the actuators 18 for the length of the support arms.

Furthermore, the computer 15 receives signals from the clip gauge 12 of each support arm and determines therefrom the weight in the individual support arms, checks their reliability and the distribution of weight, as well as their plausibility by comparing them with the weight impacting the lifting columns.

Additionally the computer 15 obtains data from the sensors 13, which check the locking of the support arm and ultimately also data from the camera 5, which records the vehicle position in reference to the hoist. Using the latter data practically the adjustment occurs of the target position to the actual vehicle position.

The data transmitted to the computer can be shown on the display 6 of the hoist, if necessary, and independent therefrom permanently saved in the data memory 16 for control purposes.

Summarizing, the present invention therefore provides a considerable increase in safety because faulty operation of the hoist is practically excluded. Simultaneously the operation of the hoist is considerably more comfortable, because the operator can monitor the adjustment of the support arms at the display and by a motorized drive of the pivotal levers the entire process can be automated.

The invention claimed is:

1. A hoist for vehicles, comprising two lifting columns, which are arranged at both sides of a vehicle, each of the lifting columns comprises two support arms that are supported on the lifting column for pivotal movement in a horizontal plane, each of the support arms comprising a support plate at a free end of the support arm, and the support plates are positionable at support positions underneath the vehicle at target positions specified by a vehicle manufacturer by pivotal movement of the support arms to a pivotal angle in the horizontal plane and by a longitudinal adjustment of the respective support arms to adjust lengths thereof, a data memory of the hoist in which coordinates of the support positions stipulated by the manufacturer are saved as target positions in connection with the respectively corresponding vehicle model, and a computer configured to make a comparison of coordinates of actual support positions of the support plates that are determined by measurements or by measurements and calculations, and coordinates of the target positions, and the computer being configured to enable a lifting process of the support arms only when differences between the target and the actual coordinates are within a predetermined tolerance.

2. The hoist according to claim 1, further comprising a display, and the computer is configured to show the target and the actual positions of the support plates on the display.

3. The hoist according to claim 2, wherein all of the target positions or all of the actual positions are displaceable on the display.

4. The hoist according to claim 1, further comprising a measurement sensor for the pivotal angle of each of the support arms and a length measurement device that determines the length of the support arms, and the computer is configured to make a determination of the actual coordinates of the support plates using the pivotal angle of the support arms and the length of the support arms.

5. The hoist according to claim 1, further actuators connected to the support arms for pivoting and longitudinal adjustment of the support arms, and the computer is configured to automatically control the actuators for positioning the support arms based on the comparison between the target and the actual coordinates.

6. The hoist according to claim 1, further a camera adapted to optically detect a position of the vehicle standing in the hoist prior to lifting the vehicle that transmits the position to the computer for the comparison between the target and the actual coordinates.

7. The hoist according to claim 1, wherein the target and the actual coordinates of the support plates are detected an x-direction, y-direction, and z-direction.

8. The hoist according to claim 7, further comprising a lifting motor connected with each of the support plates to allow individual support plate height adjustment.

9. The hoist according to claim 1, further comprising a sensor for determining a weight impacting upon it connected to each of the support arms.

10. The hoist according to claim 9, wherein the sensor for determining a weight comprises a clip gauge.

11. The hoist according to claim 9, wherein the sensors are in communication with the computer to transmit the weight determined and the computer is configured to control an overall load and load distribution.

12. The hoist according to claim 11, wherein the computer is configured to compare the weight detected at the support arms with a weight detected at the lifting columns and signals when a predetermined tolerance is exceeded.

13. The hoist according to claim 1, wherein the computer is configured to document and save data on each lifting process with respect to the target and the actual positions of the support plates, or the target and the actual positions of the support plates and at least one of a weight or a locking of the support arms.

14. The hoist according to claim 1, further comprising a data memory connected to the computer, and the computer and the data memory are adapted to be in communication with and control a plurality of the hoists.

15. A method for operating a hoist for vehicles comprising providing a hoist having at least two lifting columns, which are arranged at both sides of a vehicle, and each of the lifting columns comprise two support arms that are supported at the respective lifting column for pivotal movement in a horizontal plane, each of the support arms comprising a support plate at a free end of the lifting arm, and the support plates are positionable at support positions underneath a vehicle at target positions specified by the vehicle manufacturer by pivotal movement of the support arms to a pivotal angle in the horizontal plane and by a longitudinal adjustment of the respective support arms to adjust lengths thereof, the coordinates of the support positions specified by the manufacturer, are saved as the target positions in connection with the respectively corresponding vehicle model in a data memory of the hoist, determining coordinates of actual positions of the support plates by at least one of measurements and calculations, using a computer to carry out a comparison between coordinates of the target positions and the actual coordinates, and enabling a lifting process of the support arms only when differences between the target coordinates and the actual coordinates are within a predetermined tolerance.

* * * * *